United States Patent [19]

McCue et al.

[11] Patent Number: 4,911,971

[45] **Date of Patent: * Mar. 27, 1990**

[54] FLUSH FITTING PROTECTIVE STRIP ASSEMBLY

[75] Inventors: David S. McCue, Marblehead, Mass.; Roland Gebhardt, New York, N.Y.

[73] Assignee: Boston Metal Products, Medford, Mass.

[ * ] Notice: The portion of the term of this patent subsequent to Feb. 28, 2006 has been disclaimed.

[21] Appl. No.: 220,523

[22] Filed: Jul. 18, 1988

Related U.S. Application Data

[63] Continuation of Ser. No. 46,836, May 4, 1987, Pat. No. 4,808,451.

[51] Int. Cl.[4] ..... E04F 19/02; B60J 11/00

[52] U.S. Cl. ..... 428/99; 428/31; 293/126; 293/128; 52/717.1; 52/718.1; 24/293

[58] Field of Search ..... 428/31, 99; 293/126, 293/128; 24/292–297; 52/717.1, 718.1

[56] References Cited

U.S. PATENT DOCUMENTS 3,889,320 6/1975 Koscik ..... 24/73 PM
4,808,451 2/1989 McCue ..... 428/99 X

*Primary Examiner*—Alexander S. Thomas
*Attorney, Agent, or Firm*—Hale and Dorr

[57] ABSTRACT

The invention features, either separately or in combination, a mounting member and an elongated strip of resilient material which strip is secured in and partially surrounds the mounting member, where the resilient strip member has a semi-cylindrical body with a pair of circumferentially facing edge portions. The resilient strip also includes a pair of oppositely disposed, radially-inwardly extending latch members, each extending longitudinally of the latch member and located between one of the edge portions and a point away from the mid-line of the semi-cylindrical body. The mounting member includes a web portion having a pair of oppositely disposed web-latch extensions extending across a chord of the semi-cylindrical body, substantially parallel to a tangent to the circumference of the semi-cylindrical body at its mid-line, and at least one leg member extending from the web portion away from the semi-cylindrical body. A pair of oppositely disposed base members, each extend from a leg member, away from each other and each terminate in a base latch portion. Each of the pair of web latch extensions mates with the semi-cylindrical body adjacent the radial latch member, between the latch member and the mid-line of the semi-cylindrical body and each of the pair of base latch portions mates with the semi-cylindrical body adjacent the radial latch member, between the latch member and the closest edge portion.

8 Claims, 2 Drawing Sheets

FLUSH FITTING PROTECTIVE STRIP ASSEMBLY

This is a continuation of co-pending application Ser. No. 046,836 filed on May 4, 1987 U.S. Pat. No. 4,808,451.

BACKGROUND OF THE INVENTION

This invention relates generally to protective strip assemblies and more particularly, to bumper strip assemblies for protecting furniture edges, wall and display case surfaces and the like. Protective strip assemblies using resilient strip materials in various types of channels are known in the art, as illustrated in U.S. Pat. No. 4,083,592 and the patents cited therein. The protective strip assembly disclosed in that patent includes a metal channel capped by strip of a resilient material, such as rubber. The channel, which may be roughly rectangular in its outside cross-section attaches to a surface to be protected. The channel engages the resilient rubber strip along the channel face that faces away from the surface to be protected. The rubber strip is therefore spaced away from the surface to be protected by the thickness of the metal channel.

Because a significant segment of the metal channel is exposed, injury may occur to objects tat come in contact with the channel. It is also sometimes desirable for aesthetic reasons to completely cover the channel. Particularly, the resilient strip does not contact the surface to be protected. Therefore, the appearance of the assembly may be choppy and not suitable for refined use such as product display cases in fine stores, etc. Further, it is difficult and expensive to match the color of the channel and the resilient strip, both of which are visible. Further, small particles, such as food, articles being manufactured, and dirt collect in the juncture between the metal channel and the resilient strip, thereby rendering cleanup difficult.

It has been proposed to modify the known channel and strip assembly to permit complete cover of the channel. As can be seen in FIG. 6, the channel 518 engages the resilient strip 514 at latch points 542. To extend the base o channel 518 outward from points 560, to engage further extensions of strip 514, extending down from points 664 presents drawbacks. The resultant strip 514 becomes very complicated in shape and thus, expensive to make. Further, it is extremely difficult to mold the resilient strip so that all four of the thus needed latch engagement points will mate properly with corresponding points on the metal channel.

Thus, some of the principal objects of the invention are: to provide a protective strip assembly that permits the resilient strip to extend to flush up against the surface to be protected; to provide an assembly that presents a limited number of surface interfaces; to provide an improved assembly, the color of which may be easily and uniformly adapted; to provide a flush mounting strip assembly that is inexpensive to make and that may be easily and confidently assembled.

SUMMARY OF THE INVENTION

The invention features, either separately or in combination, a mounting member and an elongated strip of resilient material which strip is secured in and partially surrounds the mounting member, where the resilient strip member is a semi-cylindrical body having pair of circumferentially facing edge portions. The resilient strip also includes a pair of oppositely disposed, radially-inwardly extending latch members, each extending longitudinally of the strip and located between one of the edge portions and a point away from the mid-line of the semi-cylindrical body. The mounting member includes a web portion having a pair of oppositely disposed web-latch extensions extending across a chord of the semi-cylindrical body, substantially parallel to a tangent to the circumference of the semi-cylindrical body at its mid-line, and at least one leg member extending from the web portion away from the semi-cylindrical body. A pair of oppositely disposed base members, each extend from a leg member, away from each other and each terminate in a base latch portion. Each of the pair of web latch extensions mates with the semi-cylindrical body adjacent the radial latch member, between the latch member and the mid-line of the semi-cylindrical body and each of the pair of base latch portions mates with the semi-cylindrical body adjacent the radial latch member, between the latch member and the closest edge portion. In preferred embodiments the web lath extensions extend outwardly to a position closely adjacent, but inward of a projection of the base latch portions and the base latch portions extend upwardly to a position closely adjacent but below a projection of the web latch extensions. In a preferred embodiment, a pair of oppositely disposed, spaced a part leg members are used, and each base member extends from one leg member. In a preferred embodiment, the radially extending latch portions are hollow to permit snug retention. In another preferred embodiment, the base latch portions are upwardly extending beads.

Other objects, features and advantages of the invention will be apparent to those skilled in the art from the following detailed description of the preferred embodiments in view of the accompanying drawing.

BRIEF DESCRIPTION OF THE FIGURES OF THE DRAWING

Like elements are referred to by like reference in the various figures numerals.

DETAILED DESCRIPTION OF THE PREFERRED EMBODIMENTS OF THE INVENTION

Figure 1:
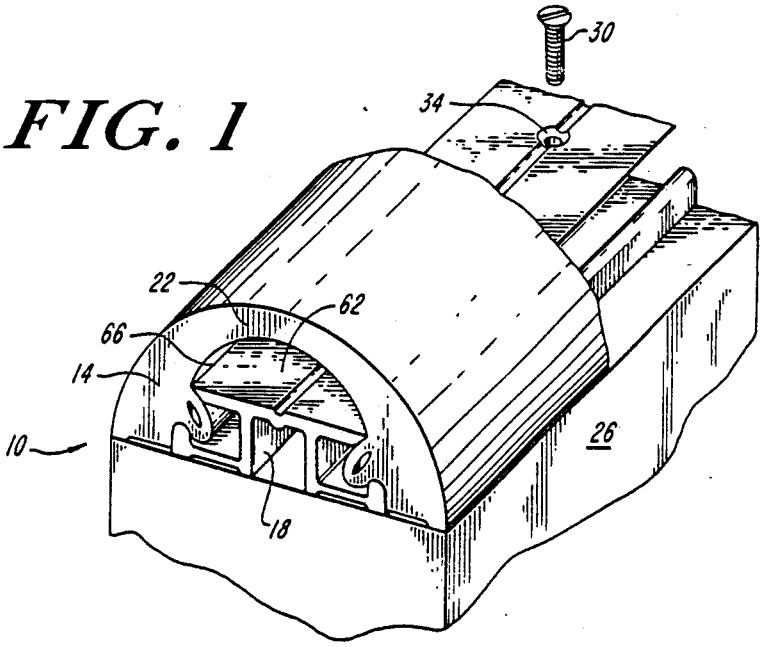
FIG. 1 is a perspective view of a portion of a combined resilient strip and mounting member assembly, with some portions of the resilient strip removed.

Referring now to FIG. 1, a resilient strip assembly 10 is shown in perspective, showing a resilient strip 14 and a mounting member 18, with some portions of the resilient strip 14 removed. The resilient strip 14 is generally a semi-cylindrical body 22 which surrounds the mounting member 18 on three of its four sides. The mounting strip 18 may b secured to the surface to be protected 26 by means of mounting screws shown representatively at 30 which secure the mounting member through hole 34.

Figure 4:
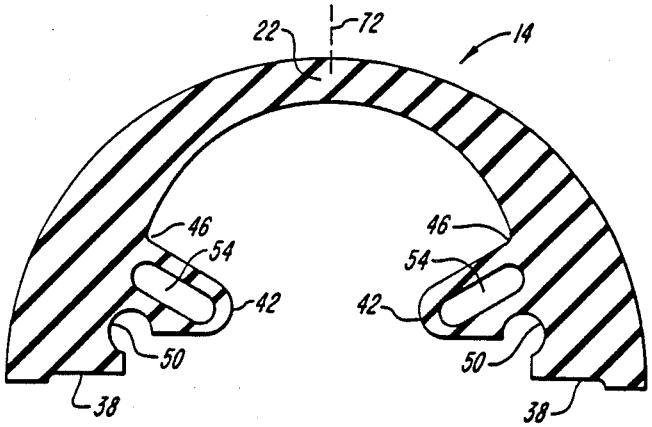
FIG. 4 is a to scale cross-section of a preferred embodiment of the resilient strip of the invention.

Referring now also to FIG. 4, which shows the resilient strip 14 alone, it can be seen that the resilient strip is a semi-cylindrical body 22 bounded by circumferentially facing edge portions 38. Latch members 42 extend radially inwardly from the semi-cylindrical body 22 from between the edge portions 38 and a point 45 degrees away from the mid-line 72 of the semi-cylindrical body 22. As shown in FIG. 1, latch members 42 extend longitudinally along the length of the resilient strip 14. Flanking each radially extending latch member 42 are a pair of radii 46 and 50. As can be seen from FIG. 4, radially projecting latch members 42 may be hollow, each having a lumen 54 running along the length thereof. Lumens 54 facilitate assembling and disassembling the strip assembly, by providing a releasable spring retention force, as explained below.

Figure 2:
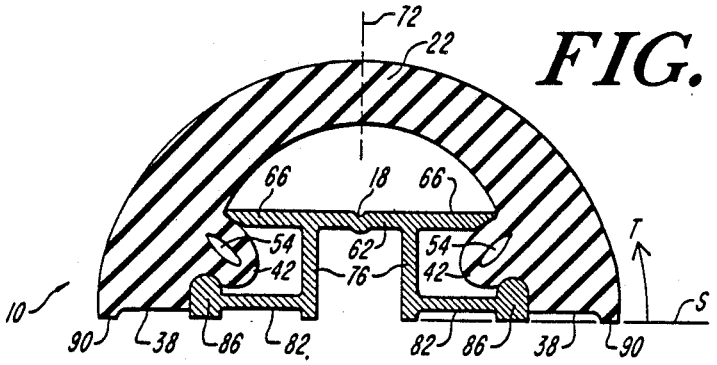
FIG. 2 is a to scale cross-section of a preferred embodiment of the invention showing both the mounting member and the resilient strip.
Figure 5:
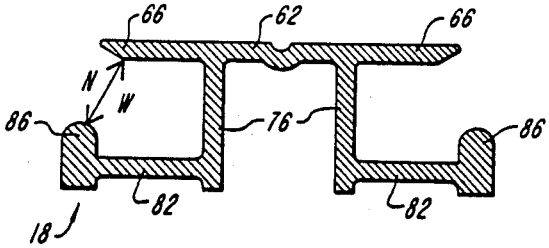
FIG. 5 is a to scale cross-section of a preferred embodiment of the mounting member of the invention.
Figure 6:
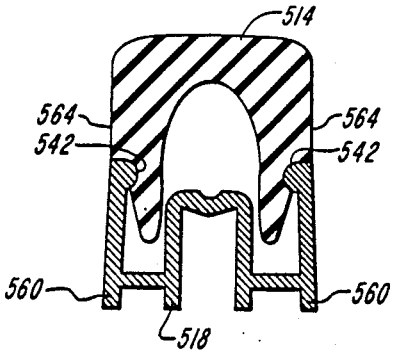
FIG. 6 (PRIOR ART)
FIG. 6 is a cross-section of assembly of the prior art.

Turning now to FIG. 5, the structure of the mounting member 18 may be seen. The mounting member 18 has a web portion 62, which includes a pair of oppositely disposed web latch extensions 66. Referring to FIG. 2, it can be seen that when the mounting member 18 and resilient strip 14 are assembled, the web portion 62 extends across a chord of the semi-cylindrical body 22, substantially parallel to a tangent to the circumference of the semi-cylindrical body portion at its mid-line 72.

Returning now to FIG. 5, a pair of oppositely disposed spaced apart leg members 76 extend from the web portion 62, away from the semi-cylindrical body 22. From each leg member 76 extends a base member 82. The base members 82 extend away from each other. Each base member 82 terminates in a base latch portion 86, which in the embodiment shown in FIGS. 2 and 5, is essentially a bead.

As oriented in FIG. 5, the web latch extensions 66 extend outwardly to a position closely adjacent but inward of an upward projection of the base latch portions 8 and the base latch portions 86 extend upwardly to a position closely adjacent but below an outward projection of the web latch extensions 66.

Referring now to FIG. 2, the mating of the resilient strip 14 and mounting member 18 maybe seen. The latch extensions 66 of the web portion 62 are sized to extend to the semi-cylindrical body adjacent the radially inwardly extending latch portions 42. Likewise, the base latch portions 86 mate with the semi-cylindrical body 22 adjacent the other side of the radially extending latch portions 42. Thus, each radially extending latch portion 42 is clamped between a respective web latch extension 66 and base latch portion 86. Insertion is facilitated due to the presence of lumens 54, which permit snug retention of the strip 14 in the mounting member 18. As the resilient strip 14 is pressed against the mounting member 18, the leading edges of the radially extending latch members 42 wedge between web latch member 66 and base latch member 86, which latch members squeeze together the walls of the radially extending latch member 42.

As will be understood, the shortest distance N between web latch extension 66 and base latch portion 86, perpendicular to the path of insertion of radially extending latch member 42, should be smaller than the width of latch member 42, to impede removal. Further, the space W beyond the narrowest spot N should be wider than the narrowest distance to permit the radially extending latch member 42 to expand after insertion, thereby locking itself in place.

Figure 3:
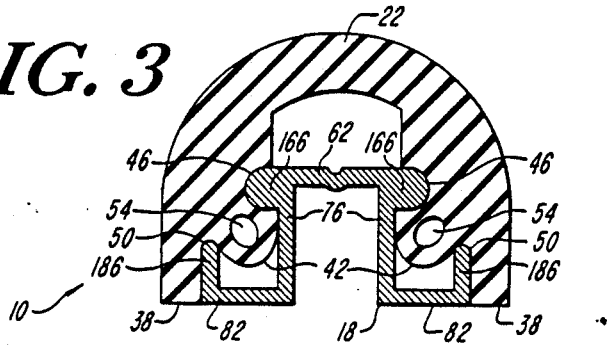
FIG. 3 is a to scale cross-section of another preferred embodiment of the invention, also showing the mounting member and the resilient strip.

Referring to FIG. 3, another preferred embodiment of the invention is shown. This embodiment of the invention is more suited for smaller, finer applications. In this case, the semi-cylindrical body member 22 again has end portions 38, radially inwardly extending latch portions 42 and lumens 54. Mountingmember 18 also has web portion 62, including web latch extensions 166, leg portions 76, and base portions 82, which include base latch portions 186. In the embodiment shown in FIG. 3, web latch extensions 166 are beads, rather than straight extensions. Conversely, base latch portions 186 are straight vertical extensions, rather than beads, as at 86 in FIG. 2. Either latch type may be used, depending upon design questions of molding and retention.

Referring to FIG. 3, another feature of the invention may be seen. Adjacent radially extending latch portions 42 of the semi-cylindrical body 22 are a pair of longitudinally extending radii, 46 and 50. Radii 46 and 50 constitute latch wall surfaces and mate with web latch extension 166 and base latch portion 186 mate respectively. The inclusion of radii, while not necessary, may enhance retention depending upon the overall size of the assembly. For instance, as show in FIG. 4, radii 46 may be very slight. Radii 50 may also be less pronounced, or even absent.

Another feature of the invention is shown in FIG. 2. The line S shows schematically the surface upon which the strip assembly will be mounted. Edge portion 38 includes a lug portion 90, which contacts the surface S. When the strip assembly is not attached to the surface to be protected, lug portion 90 extends beyond (below as seen in FIG. 2) the bottom surface of the mounting member 18. As the strip assembly is attached to surface S by means of screws or other mounting devices, the lug portion 90 is forced away from the surface in the direction of the arrow T. This force at T creates a torque about the end of latch extension 66, which further drives the resilient strip 22 into mating relationship with the mounting member 18.

Additional features of the invention will be appreciated by those skilled in the art. The invention provides shock absorbing capacity, due in part to the space between the semi-cylindrical body portion 22 and the web portion 62 of the mounting member 18. The strip portion may be advantageously made from vinyl, such as polyvinyl chloride. Polyvinyl chloride is non-marking and provides a high degree of impact and abrasion resistance. It may be colored to virtually any desirable color. The mounting member 18 may be advantageously fabricated from aluminum, and may also be fabricated from a sufficiently rigid plastic or a graphite composite. The mounting member 18, rather than being a long channel equal in length to the resilient strip may be a plurality of shorter strips, spaced apart from each other.

The flush mounted strip assembly may be advantageously used around refrigeration cases, along walls and corridors to protect the walls and corridors from impact due to moving carriages, around checkout counters in grocery and department stores, around island displays in department stores and upon the ends of display cases. The strips protect not only the surface upon which they are mounted, but also objects and persons that may contact those surfaces.

The foregoing description should be taken as illustrative and not limiting in any sense. Other embodiments of the invention will occur to those skilled in the art and are within the scope of the following claims.

What is claimed is:

1. An elongated channel mounting member for assembly with an elongated strip of resilient material to form a protective strip assembly comprising:

a. a web portion having a first substantially planar surface and a pair of oppositely disposed web latch extensions;

b. at least one leg member projecting from a second surface opposite said first surface, said at least one leg members extending away from the first surface of the web portion;

c. a pair of oppositely disposed coplanar base members:

(1) each extending from a leg member, away from each other; and (2) each terminating in a base latch portion projecting substantially parallel to said at least one leg member, projecting from said base members toward said web portion.

2. The channel mounting member of claim 1 wherein the at least one leg member comprises two leg members and each oppositely disposed base member extends away from one leg member.

3. The channel mounting member of claim 2, wherein the channel mounting member is aluminum.

4. The channel mounting member of claim 2, wherein the channel mounting member is a rigid plastic.

5. The channel mounting member of claim 2, wherein the channel mounting member is a rigid graphic composite.-

6. The channel mounting member of claim 2 wherein the web latch extensions extend outwardly to a position closely adjacent but inward of a projection of the base latch portions.

7. The channel mounting member of claim 2 wherein the base latch portions extend to a position closely adjacent but spaced away from an outward projection of the web latch extensions said projection in the plane of said web portion.

8. An elongated channel mounting member for assembly with an elongated strip of resilient material to form a protective strip assembly comprising:

a. a web portion having a first substantially planar surface and a pair of oppositely disposed web latch extensions;

b. at least one leg member projecting from a second surface opposite said first surface, said at least one leg members extending away from the first surface of the web portion;

c. a pair of oppositely disposed coplanar base members;

(1) each extending from a leg member, away from each other, (2) each terminating in a base latch portion projecting toward the plane defined by said first surface of said web portion, to an extent that the distance between the tip of each base latch portion and the tip of the nearest web latch portion is less than the distance between any other pair of points of the base portion and the nearest web portion.

* * * * *